US011737515B2

(12) United States Patent
Guest et al.

(10) Patent No.: US 11,737,515 B2
(45) **Date of Patent: *Aug. 29, 2023**

(54) FOOTWEAR HEEL STRUCTURE

(71) Applicant: NIKE, Inc., Beaverton, OR (US)

(72) Inventors: Stefan E. Guest, Portland, OR (US); Olivier Henrichot, Tigard, OR (US); Eric A. Larson, Arlington, TX (US)

(73) Assignee: NIKE, Inc., Beaverton, OR (US)

( * ) Notice: Subject to any disclaimer, the term of this patent is extended or adjusted under 35 U.S.C. 154(b) by 223 days.

This patent is subject to a terminal disclaimer.

(21) Appl. No.: 16/910,300

(22) Filed: Jun. 24, 2020

(65) Prior Publication Data

US 2020/0315295 A1 Oct. 8, 2020

Related U.S. Application Data

(63) Continuation of application No. 15/827,384, filed on Nov. 30, 2017, now Pat. No. 10,758,006.

(60) Provisional application No. 62/428,509, filed on Nov. 30, 2016.

(51) Int. Cl.

| | |
|---|---|
| ***A43B 21/24*** | (2006.01) |
| ***A43B 21/22*** | (2006.01) |
| ***A43B 13/14*** | (2006.01) |
| *A43B 3/00* | (2022.01) |

(52) U.S. Cl.

CPC ..... *A43B 21/24* (2013.01); *A43B 13/145* (2013.01); *A43B 13/148* (2013.01); *A43B 21/22* (2013.01); *A43B 3/0036* (2013.01)

(58) Field of Classification Search

CPC ..... A43B 13/145; A43B 21/22; A43B 21/24

See application file for complete search history.

(56) References Cited

U.S. PATENT DOCUMENTS

| | | | | |
|---|---|---|---|---|
| 186,843 | A * | 1/1877 | Johnson | A43B 3/166 36/70 R |
| 1,208,160 | A | 12/1916 | Jansen | |
| 2,285,751 | A * | 6/1942 | Tamaki | A43B 11/02 36/1 |
| 2,495,195 | A * | 1/1950 | Denzer | A43B 3/166 36/70 R |
| 2,521,021 | A * | 9/1950 | Robinson | A43B 3/166 36/70 R |

(Continued)

FOREIGN PATENT DOCUMENTS

| | | |
|---|---|---|
| EP | 2454959 A1 | 5/2012 |
| ES | 2088746 B1 | 3/1997 |

(Continued)

OTHER PUBLICATIONS

"Air Jordan XV (15) Original—OG Flint Grey/White", SneakerFiles, Available Online at: <https://www.sneakerfiles.com/air-jordans/jordan-15/air-jordan-xv-15-orginal-og-flint-grey-white/>, Accessed on Mar. 30, 2018, 2 pages.

(Continued)

*Primary Examiner* — Jila M Mohandesi

(74) *Attorney, Agent, or Firm* — Shook, Hardy & Bacon LLP

(57) ABSTRACT

A heel structure for an article of footwear protrudes rearward from a heel region of an article of footwear in a direction generally aligned with the longitudinal orientation of the footwear article.

16 Claims, 10 Drawing Sheets

(56) References Cited

U.S. PATENT DOCUMENTS

| | | | | | |
|---|---|---|---|---|---|
| 4,030,213 | A * | 6/1977 | Daswick | A43B 13/12 | 36/114 |
| 4,238,894 | A * | 12/1980 | Evans | A43B 7/00 | 36/83 |
| 4,255,877 | A | 3/1981 | Bowerman | | |
| 4,259,792 | A * | 4/1981 | Halberstadt | A43B 13/143 | 36/129 |
| 4,314,413 | A * | 2/1982 | Dassler | A43B 5/00 | 36/129 |
| 4,854,057 | A | 8/1989 | Misevich et al. | | |
| 5,276,983 | A * | 1/1994 | Hatfield | A43B 11/00 | 36/1 |
| 5,343,638 | A | 9/1994 | Legassie et al. | | |
| 5,371,903 | A * | 12/1994 | Lew | A41D 13/00 | 2/88 |
| RE35,708 | E * | 1/1998 | Malloy | B63B 32/45 | 36/114 |
| D406,688 | S | 3/1999 | Winters et al. | | |
| D460,605 | S | 7/2002 | Whittington | | |
| 6,708,424 | B1 | 3/2004 | Ellis, III | | |
| D554,842 | S | 11/2007 | Gaenssler et al. | | |
| D566,942 | S | 4/2008 | Juan | | |
| D575,488 | S | 8/2008 | Covatch | | |
| 7,493,708 | B2 | 2/2009 | Crowley, Jr. | | |
| 7,600,332 | B2 | 10/2009 | Lafortune | | |
| D633,698 | S | 3/2011 | McMillan | | |
| 7,980,010 | B2 * | 7/2011 | Davis | A43B 11/00 | 36/105 |
| 8,065,819 | B2 * | 11/2011 | Kaufman | A43C 11/008 | 36/122 |
| 8,272,149 | B2 * | 9/2012 | Cooper | A43B 13/141 | 36/102 |
| 8,671,588 | B2 * | 3/2014 | Hampton | A43B 3/18 | 36/7.1 R |
| 8,745,900 | B2 | 6/2014 | Bryne | | |
| 8,769,845 | B2 * | 7/2014 | Lin | A43B 11/02 | 36/138 |
| D711,638 | S | 8/2014 | Wu et al. | | |
| 9,844,243 | B2 * | 12/2017 | Langvin | B44C 1/1712 | |
| 2002/0008124 | A1 * | 1/2002 | Runge | A43B 11/02 | 223/119 |
| 2003/0009916 | A1 * | 1/2003 | Bernstein | A43B 11/00 | 36/138 |
| 2007/0043630 | A1 | 2/2007 | Lyden | | |
| 2007/0209234 | A1 * | 9/2007 | Chou | A43B 11/00 | 36/138 |
| 2009/0013556 | A1 | 1/2009 | Nishiwaki et al. | | |
| 2009/0260259 | A1 | 10/2009 | Berend | | |
| 2010/0000125 | A1 | 1/2010 | Lafortune | | |
| 2011/0056095 | A1 | 3/2011 | Torrance | | |
| 2011/0314701 | A1 | 12/2011 | Rod et al. | | |
| 2012/0060395 | A1 | 3/2012 | Blevens et al. | | |
| 2012/0307060 | A1 | 12/2012 | Henderson | | |
| 2013/0167401 | A1 | 7/2013 | Christensen et al. | | |
| 2014/0259788 | A1 | 9/2014 | Dojan et al. | | |
| 2015/0351492 | A1 | 12/2015 | Dombrow et al. | | |
| 2016/0037857 | A1 | 2/2016 | Foxen | | |
| 2016/0302494 | A1 | 10/2016 | Smart | | |
| 2018/0146744 | A1 | 5/2018 | Guest et al. | | |

FOREIGN PATENT DOCUMENTS

| | | | |
|---|---|---|---|
| JP | 2005349069 | A | 12/2005 |
| JP | 2014176633 | A | 9/2014 |
| KR | 20100123278 | A | 11/2010 |
| WO | 00/36939 | A1 | 6/2000 |
| WO | 2010/042924 | A1 | 4/2010 |
| WO | 2015/097666 | A1 | 7/2015 |

OTHER PUBLICATIONS

"CXR Ultimate Shoe", Mavic, Available Online at: <http://web.archive.org/web/20150312200054/http://www.mavic.com/footwear-road-cxr-ultimate-shoe>, Accessed on Mar. 12, 2015, 1 page.

"Tall Shoe Cover", veloToze, Available Online at: <https://www.velotoze.com/products/tallshoecover?variant=19464978758>, Accessed on Jul. 2016, 3 pages.

Office Action received for European Patent Application No. 17821759.2, dated Jun. 13, 2022, 6 pages.

* cited by examiner

FOOTWEAR HEEL STRUCTURE

CROSS REFERENCE TO RELATED APPLICATIONS

This application is a continuation of U.S. patent application Ser. No. 15/827,384 (filed Nov. 30, 2017), which claims priority to U.S. Provisional Patent Application No. 62/428,509 (filed on Nov. 30, 2016). Each of the aforementioned applications is incorporated herein by reference in its entirety.

TECHNICAL FIELD

This disclosure relates to a heel structure for a footwear article.

BACKGROUND

Different types of footwear articles may include various structures. For example, an athletic shoe may include an upper and a sole structure, in which the upper secures a wearer's foot to the sole structure and the sole structure may provide cushioning, responsiveness, impact attenuation, and protection, among other things.

BRIEF DESCRIPTION OF THE DRAWINGS

Subject matter of this disclosure is described in detail herein with reference to the attached figures, which are incorporated herein by reference and are briefly described directly below.

DETAILED DESCRIPTION

Subject matter is described throughout this disclosure in detail and with specificity in order to meet statutory requirements. But the aspects described throughout this disclosure are intended to be illustrative rather than restrictive, and the description itself is not intended necessarily to limit the scope of the claims. Rather, the claimed subject matter might be practiced in other ways to include different elements or combinations of elements that are equivalent to the ones described in this disclosure. In other words, the intended scope of the claims, and the other subject matter described in this specification, includes equivalent features, aspects, materials, methods of construction, and other aspects not expressly described or depicted in this application in the interests of concision, but which would be understood by an ordinarily skilled artisan in the relevant art in light of the full disclosure provided herein as being included within the inventive scope. It will be understood that certain features and subcombinations are of utility and may be employed without reference to other features and subcombinations. This is contemplated by and is within the scope of the claims.

Figure 1:
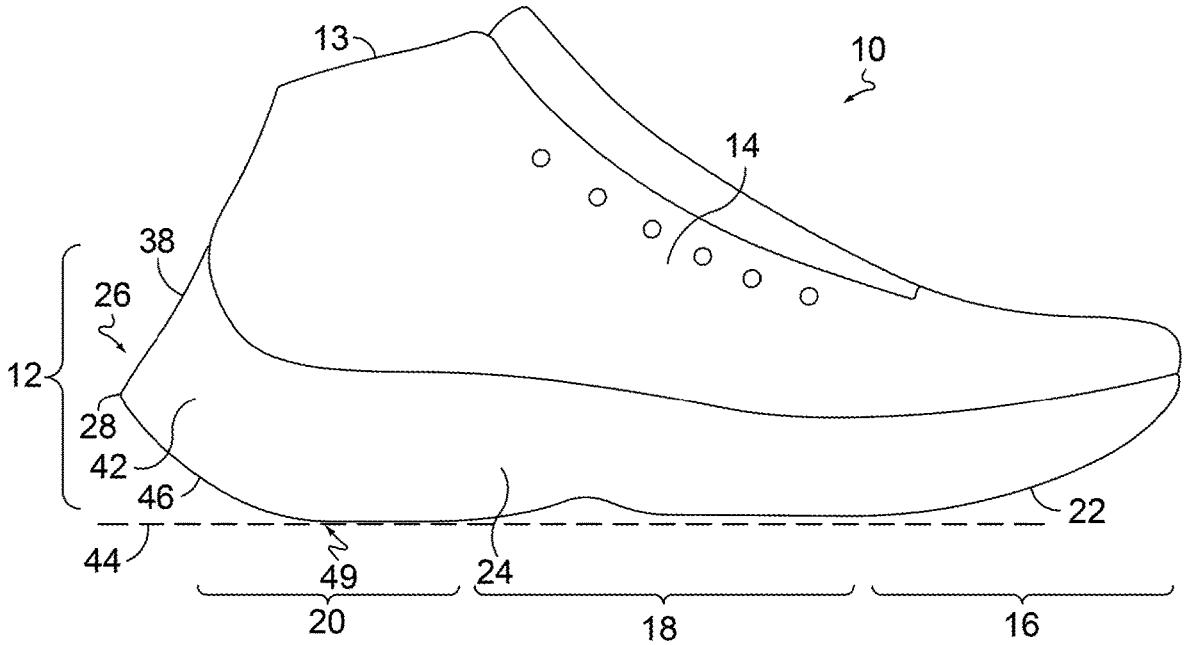
FIGS. 1-3 depict various views of a footwear article having a heel structure in accordance with an aspect hereof.

At a high level, this disclosure describes an elongated heel structure for an article of footwear. That is, generally a footwear article includes a longitudinal orientation extending from near the forefoot region to the heel region. An aspect of the disclosure includes a heel extension that protrudes rearward from the heel region and in a direction generally aligned with the longitudinal orientation. An exemplary heel extension 26 is depicted in FIG. 1, and other exemplary heel extensions having respective configurations different from FIG. 1 are depicted in various other figures included in this disclosure (e.g., FIGS. 7, 8, 9A, 9B, 10A-10D, 11, and 12). Among other functions, the heel structure may affect the dynamics and flow of a fluid medium (e.g., air) as the footwear article moves through space, such as when a person wearing the footwear article is jogging, running, sprinting, skiing, skating, and the like. For example, the heel structure may delay air separation and increase laminar flow near the rear (or posterior) portion of the footwear article, which can decrease drag imposed on the footwear article.

Figure 2:
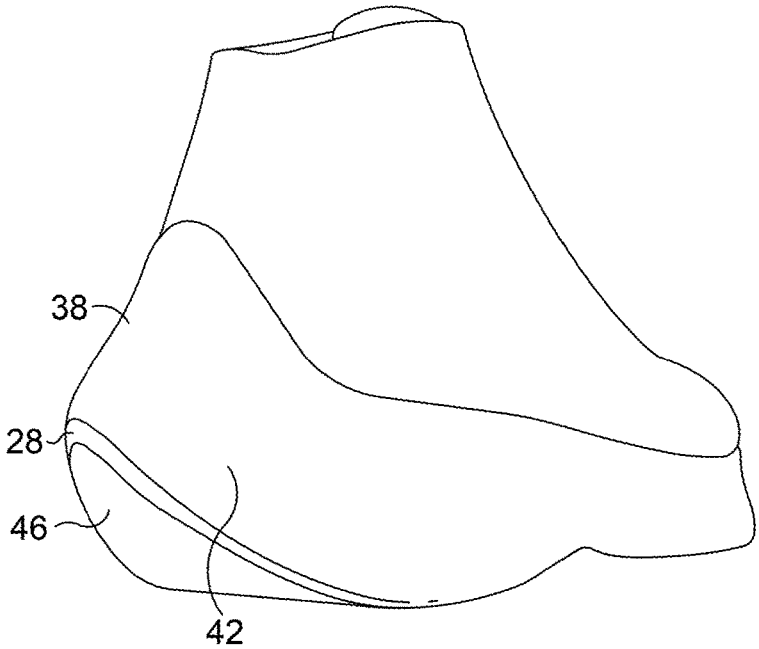
Figure 3:
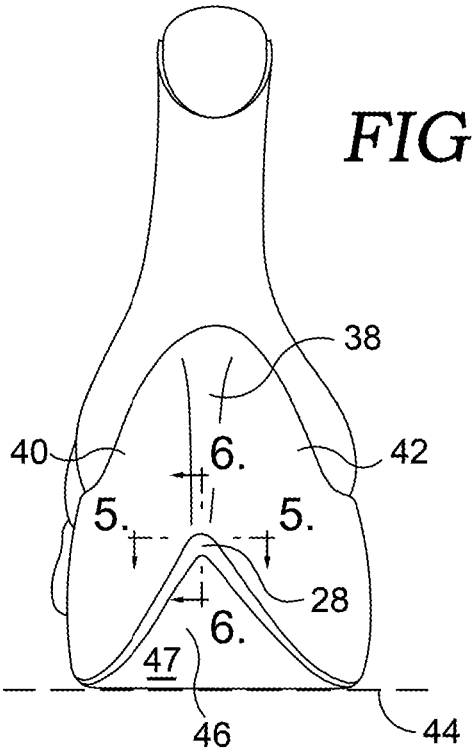

Referring now to FIGS. 1-3, an exemplary article of footwear 10 is illustrated. In FIG. 1, the footwear article 10 includes a sole 12 and an upper 14. The upper 14 and the sole 12 generally form a foot-receiving cavity that is configured to enclose at least part of a foot when the footwear is worn or donned in a normal and intended manner. The foot-receiving cavity is accessible by inserting a foot through an opening formed by the ankle collar 13.

When describing various aspects of the footwear 10, relative terms may be used to aid in understanding relative positions. For instance, the footwear 10 may be divided into three general regions: a forefoot region 16, a mid-foot region 18, and a heel region 20. The footwear 10 also includes a lateral side, a medial side, a superior portion, and an inferior portion. The forefoot region 16 generally includes portions of the footwear 10 corresponding with the toes and the joints connecting the metatarsals with the phalanges. The mid-foot region 18 generally includes portions of footwear 10 corresponding with the arch area of the foot, and the heel region 20 corresponds with rear portions of the foot, including the calcaneus bone. The lateral side and the medial side extend through each of regions 16, 18, and 20 and correspond with opposite sides of footwear 10. More particularly, the lateral side corresponds with an outside area of the foot (i.e., the surface that faces away from the other foot), and the medial side corresponds with an inside area of the foot (i.e., the surface that faces toward the other foot). Further, the superior portion and the inferior portion also extend through each of the regions 16, 18, and 20. The superior portion generally corresponds with a top portion that is oriented towards a person's head when the person's feet are positioned flat on the ground and the person is standing upright, whereas the inferior portion generally corresponds with a bottom portion oriented towards the bottom of a person's foot. These regions 16, 18, and 20, sides, and portions are not intended to demarcate precise areas of footwear 10. They are intended to represent general areas of footwear 10 to aid in understanding the various descriptions provided in this Specification. In addition, the regions, sides, and portions are provided for explanatory and illustrative purposes and are not meant to require a human being for interpretive purposes.

A sole 12 often includes an assembly of multiple components. For example, a sole 12 may comprise an outsole made of a relatively hard and durable material, such as rubber, that contacts the ground, floor, or other surface. A sole 12 may further comprise a midsole formed from a material that provides cushioning and absorbs/attenuates force during normal wear and/or athletic training or performance. Examples of materials often used in midsoles are, for example, ethylene vinyl acetate (EVA), thermoplastic polyurethane (TPU), thermoplastic elastomer (e.g., polyether block amide), and the like. Shoe soles may further have additional components, such as additional cushioning components (such as springs, air bags, and the like), functional components (such as motion control elements to address pronation or supination), protective elements (such as resilient plates to prevent damage to the foot from hazards on the floor or ground), and the like.

The upper 14 also often includes various components and features. For example, the upper 14 may be formed of a textile, such as a knit, woven, non-woven, braided, embroidered, or any combination thereof. The upper may also be constructed of other textile forms made using other techniques of strand or fiber manipulation, such as felt. As depicted in FIG. 1, the upper 14 may cover a substantial portion of the foot-receiving cavity. In yet other embodiments, the upper may enclose a smaller portion of the foot-receiving cavity, such as an open-toe shoe, open heel shoe, or sandal. Although the footwear article 10 depicted in the illustrative figures is depicted to include a running shoe, in other aspects of this disclosure the features and elements described herein, such as the heel extension, may be incorporated into other types of footwear, including (but not limited to) track spikes, ski boots, ice skates, cycling shoes, and the like.

Figure 4:
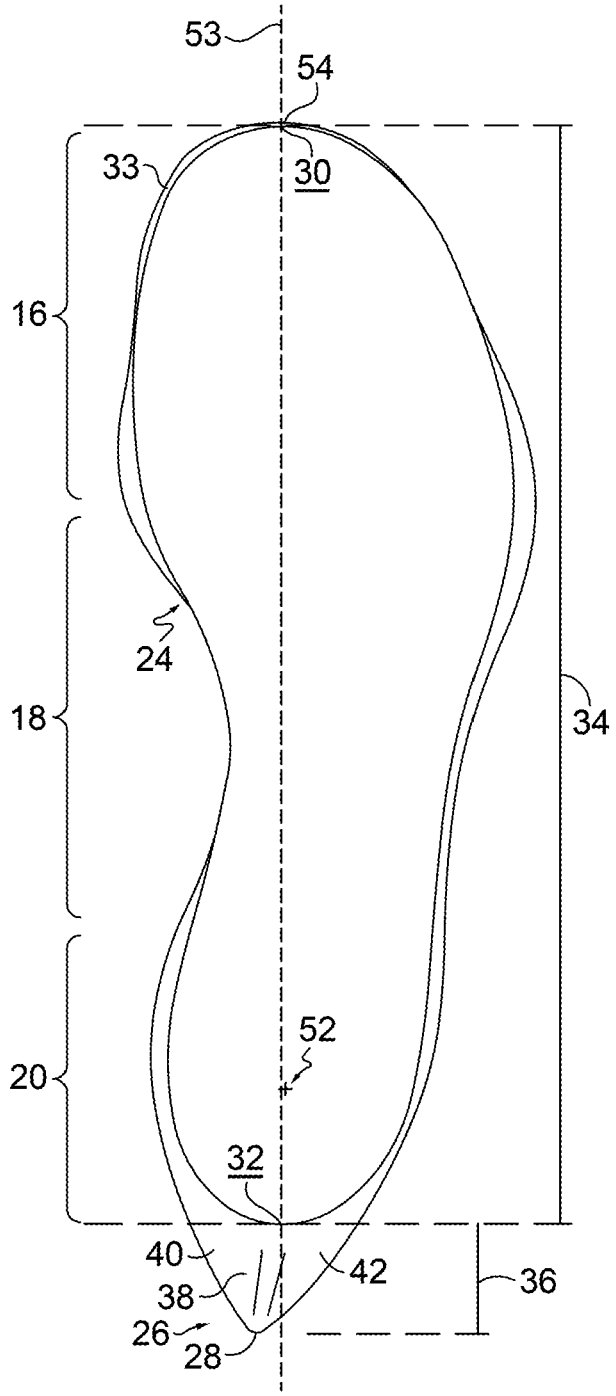
FIG. 4 depicts a midsole portion of a footwear article depicted in FIGS. 1-3 in accordance with an aspect hereof.

In FIGS. 1-3, an exemplary sole 12 is depicted that includes an outsole portion 22 and a midsole portion 24. Additional aspects of the midsole 24 are illustrated in FIG. 4, which depicts a top-down view of the midsole 24 with the upper removed. As depicted in FIG. 4, the midsole 24 includes the forefoot region 16, the mid-foot region 18, and the heel region 20 aligned in a longitudinal orientation. In addition, the midsole 24 includes a heel extension 26 protruding rearward from the heel region 20 and in a direction generally aligned with the longitudinal orientation.

The heel extension 26 includes various features that may affect an amount of drag imparted on (experienced by) the footwear article 10 when moved through space, such as when a person wearing the footwear article 10 is running, sprinting, skating, skiing, biking, and the like. Exemplary features include a length of the heel extension, as well as the manner in which the heel extension transitions from the heel region 20 towards a rearmost exterior point or apex. For example, the heel extension 26 may be configured to include a substantially uninterrupted transition from the medial and lateral sides of the heel region, the uninterrupted transition including a taper, or a gradually increasing curve, towards a rearmost exterior point. Additional features may take into account the amount of taper and/or curve, as well as the width of the heel extension 26.

These features, which will be described in more detail below, function both independently of one another, as well as together as a system, to affect the amount of drag. In addition, these features take into account context and environment in which the midsole and footwear article may move through space. For example, these features are configured to account for angular orientation and velocity of the footwear at one or more phases of a running stride. In addition, these features are configured to account for a speed and direction of airflow, including how these variables may be altered by other elements, such as the wearer's lower leg blocking at least some of the airflow during certain phases of a running stride. Furthermore, these features balance drag-reduction functionality with other features of the footwear article, such as overall weight of the footwear, gait control, cushion, responsiveness, and the like.

In one aspect of the disclosure, the heel extension 26 includes a rearmost exterior point 28 of the footwear article 10. The rearmost exterior point 28 might include various structural and dimensional features of the footwear article 10 or the midsole 24. For example, the rearmost exterior point 28 might be used to determine a total length of the midsole 24 or the footwear article 10. In addition, the rearmost exterior point 28 might establish an extent to which the heel extension 26 protrudes beyond one or more reference points of the shoe.

The one or more reference points that may be used to characterize the heel extension 26, such as a heel-extension absolute length or heel-extension relative length, may be on the sole, on the upper, or on any combination thereof. For example, as previously described, the upper 14 and the sole 12 at least partially enclose a foot-receiving cavity, and in one aspect, the reference point in the heel region includes a heel-region terminal end point forming a rearmost terminal boundary of the foot-receiving cavity. The heel-region terminal end point forming a rearmost terminal boundary of the foot-receiving cavity may be constructed of at least a portion of the sole, at least a portion of the upper, or any combination thereof. For instance, FIG. 4 illustrates a top plan view of the midsole 24 without the upper 14 being attached thereto. The midsole 24 includes a perimeter sidewall 33 (e.g., lip or ridge) that extends from the midsole and around at least a portion of a foot-receiving cavity, the sidewall providing, among other things, an attachment point for the upper (e.g., at a biteline). Furthermore, the sidewall includes a rearward-most, interior facing surface 32, which is more rearward than any other interior facing surface of the sidewall. In one aspect, the rearward-most, interior facing surface 32 of the sidewall is a reference point for assessing dimensions of the heel extension 26. In a further aspect, the sidewall 33 includes a forward-most, interior facing surface 30, which is the more forward than any other interior facing surface of the sidewall. As such, in one embodiment, a spacing or distance 34 between the rearward-most interior surface 32 and the forward-most interior surface 30 may be used to assess dimensions of the heel extension 26. For example, the heel extension 26 includes a length or distance 36 between the rearward-most, interior-facing surface 32 and the rearmost exterior point 28. As such, in one aspect the distance 36 may be used to determine an extent to which the heel extension 26 lengthens the overall length of the midsole 24 of the footwear article. The distance 36 may include a percentage of the length 34. In one aspect of the disclosure, the distance 36 includes a percentage of the length 34 in a range of about eight percent to about twenty percent. In a further aspect, the distance 36 includes a percentage of the length 34 in a range of about eight percent to about fifteen percent. In yet another aspect, the percentage is about ten percent.

As previously indicated, FIG. 4 depicts the midsole 24 with the upper omitted. As such, in one aspect the heel-region terminal endpoint may be determined without taking into account additional upper structures (e.g., material layers, heel counter, and the like) affixed to the rearward-most, interior facing surface 32. In other aspects, the material layer(s) of the upper may be taken into account when determining the heel-region terminal endpoint. In these instances, the thickness of any upper materials (such as a textile layer, heel counter, and the like) may position the heel-region terminal endpoint slightly further away from the rearmost exterior point 28 and slightly closer to a forward-most portion of the foot receiving cavity and the rearward-most portion might be positioned on the inward facing surface of the upper, as opposed to the lip or ridge 33. Further, the length 34 may be determined by measuring from the inward facing surfaces of the upper and by increasing the measured length by the thickness of the upper in the forefoot and heel regions.

The heel extension 26 includes other features as well. For example, the heel extension 26 includes a top-side median ridge 38 that slopes downward as the top-side median ridge 38 extends away from the heel region and towards the rearmost exterior point 28. The top-side median ridge 38 is illustrated to be rounded, such that the ridge 38 includes one or more radii. That is, the top-side median ridge 38 may include constant radius extending from the highest point at the interface with the heel of the upper to the rearmost exterior point 28. The radius depicted in the drawings is merely illustrative of one aspect, and in other aspects the radius may be smaller (i.e., sharper) or larger (i.e., more rounded). In other aspects, the radius of the top-side median ridge 38 may gradually decrease as the top-side median ridge 38 extends from the highest point at the interface with the heel of the upper to the rearmost exterior point 28. Furthermore, the amount of slope of the top-side median ridge 38 depicted in the drawings is illustrative of one aspect, and in other aspects the amount of slope may be greater or lesser than the amount of slope shown.

In addition, the heel extension 26 includes a medial side 40 and a lateral side 42 that are separated from one another by the top-side median ridge 38 and that converge towards the rearmost exterior point 28. The medial side 40 and the lateral side 42 generally taper from a larger width, which is closer to the heel region, to a smaller width closer to the rearmost exterior point. The medial side 40 and the lateral side 42 are illustrated to include relatively flat faces or surfaces that gradually transition at respective edges or portions. And in alternative aspects, the medial side 40 and the lateral side 42 may include a convex surface that gradually transitions from the medial side 40 to the lateral side 42, and vice versa, such that there is not a clear delineation between particular sides and the ridge. In other aspects, the medial side and the lateral side may instead include convex curved surfaces.

Furthermore, as depicted by FIGS. 1-3, the outsole 22 is generally oriented or positioned in an outsole plane 44, and the rearmost exterior point 28 is positioned above, and overhangs, the outsole plane. As depicted in FIG. 1, an outsole plane refers to a flat, two-dimensional plane that intersects at least one heel-region, lowermost, outsole surface, and at least one heel-region, lowermost, outsole surface. In other words, in the forefoot region 16 and in the heel region 20, the shoe 10 includes respective lowermost outsole surfaces that contact a ground surface when the shoe 12 is in a resting state, and the theoretical two-dimensional plane representing the ground surface is an outsole plane. As such, the heel extension 26 comprises a bottom side 46 that overhangs the plane 44 and that also converges towards the rearmost exterior point 28, the bottom side 46 generally facing away from the upper when the midsole 24 is attached to the upper. As such, the top-side median ridge 38 and the bottom side 46 generally taper from a larger width, which is closer to the heel region, to a smaller width closer to the rearmost exterior point. The bottom side 46 may include an extension of the outsole 22. And in alternative aspects, the bottom side 46 includes a portion of the midsole that is shaped and configured to form the bottom side 46. Furthermore, as depicted in FIG. 3, the bottom side 46 may include a relatively flat surface 47 extending from a medial side to a lateral side. The surface 47 may or may not include tread elements.

Figure 3B:
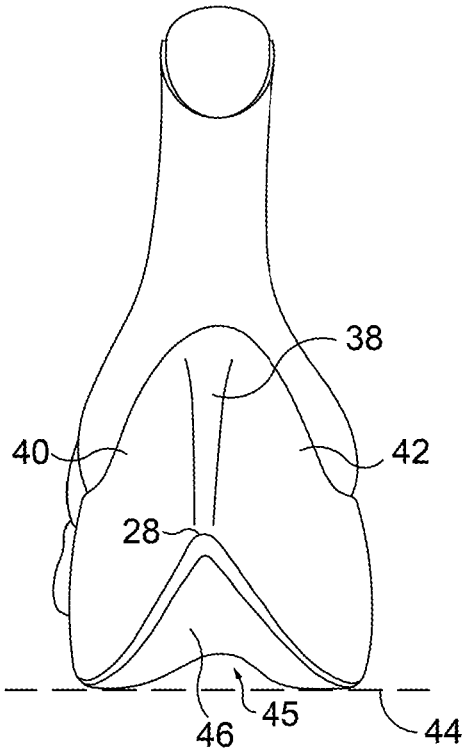
FIG. 3B depicts a rear view of an alternative footwear article having an alternative heel structure in accordance with an aspect hereof.

In a further aspect, the bottom side 46 includes an interface 49 at the transition from the outsole plane 44. The bottom side 46 may have a relatively flat surface that extends from the interface 49 to the rearmost exterior point 28. As can be seen in FIG. 1, the bottom side angles/slope upward from the interface 49 to the rearmost exterior point 28. In other aspects, the bottom side 46 may include a convex curvature extending at least partially between the interface 49 and the rearmost exterior point 49. The convex curvature may be simple and extend in a constant radius, or may be complex and have multiple different radii at different segments of the curve. In addition, the bottom side 46 may include a combination of surfaces, such as a convex curve near the interface 49 that flattens out into a relatively flat surface towards the rearmost exterior point 28. This configuration of the bottom side 46 may be selected to limit or omit hindrance of the heel extension 26 with a gait and/or foot strike of a wearer. And in other aspects, the bottom side 46 may include an upward extending, arched central region 45 as depicted in FIG. 3B.

Figure 5:
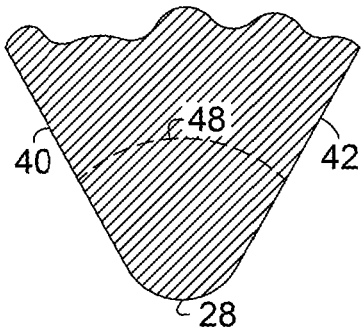
FIGS. 5 and 6 depict cross sectional views of portions of the heel extension taken at the respective reference lines shown in FIG. 3.

In an aspect of the disclosure, the top-side median ridge 38, the medial side 40, the lateral side 42, and the bottom side 46 include one or more dimensions, relationships, and configurations that at least partially determine a configuration of the heel extension 26. For example, as depicted from the top-down view of FIG. 4, the medial side 40 and the lateral side 42 taper inwardly towards one another as each side extends towards the rearmost exterior point 28. That is, the medial side 40 and the lateral side 42 taper from a wider portion, which is positioned closer to the heel region, to a narrower portion positioned closer to the rearmost exterior point 28. This tapering aspect is also depicted in FIG. 5, which shows a cross section taken along the reference plane identified in FIG. 3. In an aspect of this disclosure, the medial side 40 and the lateral side 42 form an angle 48 with one another as each side converges towards the rearmost exterior point 28. While the angle 48 could be determined at a number of different vertical depths of the heel extension (e.g., at a number of different positions along the top-median ridge 38), in one aspect, the angle is measured along a cross-reference plane that passes through the rearmost exterior point 28 and is substantially parallel with the outsole plane 44. In a further aspect, the angle is in a range of about 55 degrees to about 65 degrees. And in yet another exemplary aspect of a heel extension, the angle is about 59 degrees.

Figure 6:
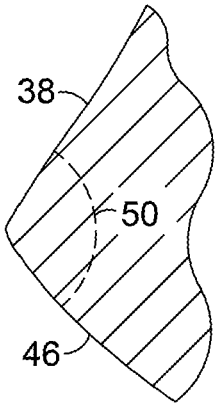

In another aspect of this disclosure, the top-side median ridge 38 and the bottom side 46 taper towards one another as each element converges towards the rearmost exterior point 28. That is, the top-side median ridge 38 and the bottom side 46 taper from a wider portion, which is positioned closer to the heel region, to a narrower portion positioned closer to the rearmost exterior point 28. This tapering is generally depicted in FIGS. 1 and 2. In addition, FIG. 6 depicts a cross section taken along the reference plane identified in FIG. 3. As such, the top-side median ridge 38 and the bottom side 46 form an angle 50 with one another as each converges towards the rearmost exterior point 28. In one aspect, the angle is measured along a cross-reference plane that extends perpendicular to the outsole plane 44 and that bisects the top-side median ridge 38. In a further aspect, the angle is in a range of about 90 degrees to about 100 degrees. And in one exemplary version of a heel extension, the angle is about 96.5 degrees.

In a further aspect, the rearmost exterior point 28 includes an orientation relative to a midline or midpoint 52 of the heel region 22, and these reference elements may be designated in various manners. In FIG. 4, the midpoint 52 is spaced evenly between a medial side of the footwear article and a lateral side of the footwear article at a depicted fore-aft position of the sole 12, and in one aspect, the midsole may include a reference line that passes through the midpoint 52 and through a center 54 of the toe end of the midsole. In yet another aspect, the midsole may include a midline reference plane 53 that passes through the center of the rearward-most, interior facing surface 32 and through the center of the forward-most, interior facing surface 30. Depending on a fore-aft position at which the midpoint is established, and depending on whether the center 54 is aligned with the forward-most interior facing surface 30, the reference line may or may not be aligned with the midline reference plane 53. In one aspect, as illustrated by FIG. 4, the rearmost exterior point 28 may be offset to the medial side relative to the midpoint 52 and the reference line passing through the midpoint and the center 54 of the toe end. In another aspect, the rearmost exterior point 28 may be offset to the medial side relative to the midline reference plane 53 that passes through the middle of the rearward-most, interior facing surface 32 and through the middle of the forward-most, interior facing surface 30. In yet other aspects (not illustrated), the rearmost exterior point 28 may be aligned with the reference line or the midline reference plane 53, or offset to the lateral side. The rearmost exterior point 28 may include positioning and/or orientation relative to other portions of the footwear article, as well. For example, the rearmost exterior point 28 may be centered with a widest portion in the heel region of the footwear article.

As previously indicated, one or more features of the heel extension 26 may be configured to reduce an amount of drag imparted on the footwear article 10 when the footwear article is in motion through a fluid medium (e.g., when a wearer is running and the fluid medium is air). Various analysis tools may be used to determine a reduction in drag at least partially arising from one or more different heel extensions, as compared with a footwear article that does not include a heel extension. For example, wind-tunnel testing may be utilized to determine a relative amount of drag for footwear articles having various combinations of features. In addition, computational fluid dynamics, or digital wind tunnels, may be utilized to assess drag force experienced by a particular footwear article and to compare relative amount of drag between footwear article having no heel extension or different heel-extension configurations. These analysis tools can be used to measure drag, or relative drag, under various conditions, such as under various wind speeds and at various footwear inclinations. These variables may be used to simulate and test the drag when a wearer is running and at different phases of a running stride. For example, in one instance footwear articles are analyzed at a 10 degree inclination and at a 42 degree inclination, which may be selected based on the orientation of a footwear article at different phases of a leg swing when running. These angles may be selected based on various criteria, such as the average inclination for a runner (or a set of test runners) when the footwear article is not obscured (i.e., blocked) by the runners leg and the footwear experiences the highest leg-swing speeds. In testing, wind speeds may be selected using various criteria, such as the average velocity of the footwear article during select moments in the leg swing during a particular event. For instance, the wind speed tested for an endurance event may be lower than the wind speed for a speed event. In one aspect, the wind speed is about 12 m/s. However, this is merely exemplary of one aspect, and in other tests the wind speed may be higher or lower.

Using these analysis tools, a heel-extension configuration may be devised that achieves an amount of drag reduction, which is balanced with other functionality of the footwear article. For example, the heel extension depicted in FIGS. 1-6 may include the relationship between the lengths 36 and 34, the angle 48, the angle 50, the alignment of the rearmost exterior point 28 and the midline (or other portions of the footwear article), and any combination thereof. In selecting these features, the amount of drag reduction may be balanced with an amount of total weight added to the footwear article arising from the additional heel-extension structure. In addition, the amount of drag reduction may be balanced with not hindering the foot strike of a runner during that particular phase of a running stride. Moreover, overall comfort of the footwear article may also be balanced, such as be selecting a top-side medial edge configuration that limits irritation of the Achilles region of a wearer and/or that limits obstruction when donning or doffing the footwear article. Moreover, the selection of particular geometries of the heel extension may be based on testing parameters used in wind-tunnel testing, computational fluid dynamics, or a combination thereof. For example, the described dimensions or ratios for the length 36, angle 48, angle 50, three-dimensional shape of the heel extension 26, and any combination thereof, may be based on the parameters used when testing the drag force on a footwear article having any one or more of these features. And in the examples provided thus far, the angles 48 and 50 may be selected based on the measured drag force at 10 degrees inclination and 42 degrees inclination at wind speeds of 12 m/s.

Figure 7:
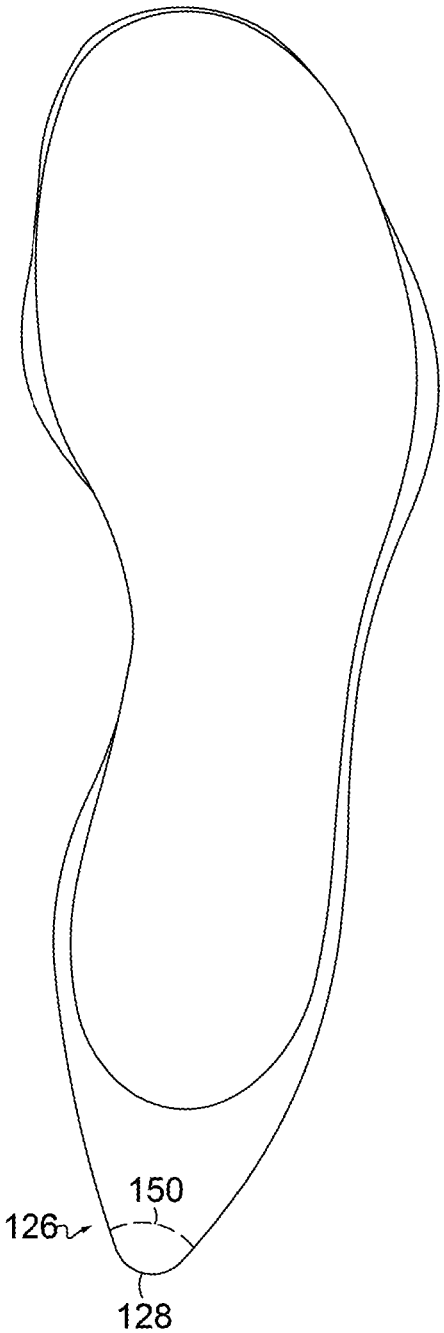
FIGS. 7 and 8 depict alternative configurations of a heel structure in accordance with aspects hereof.
Figure 8:
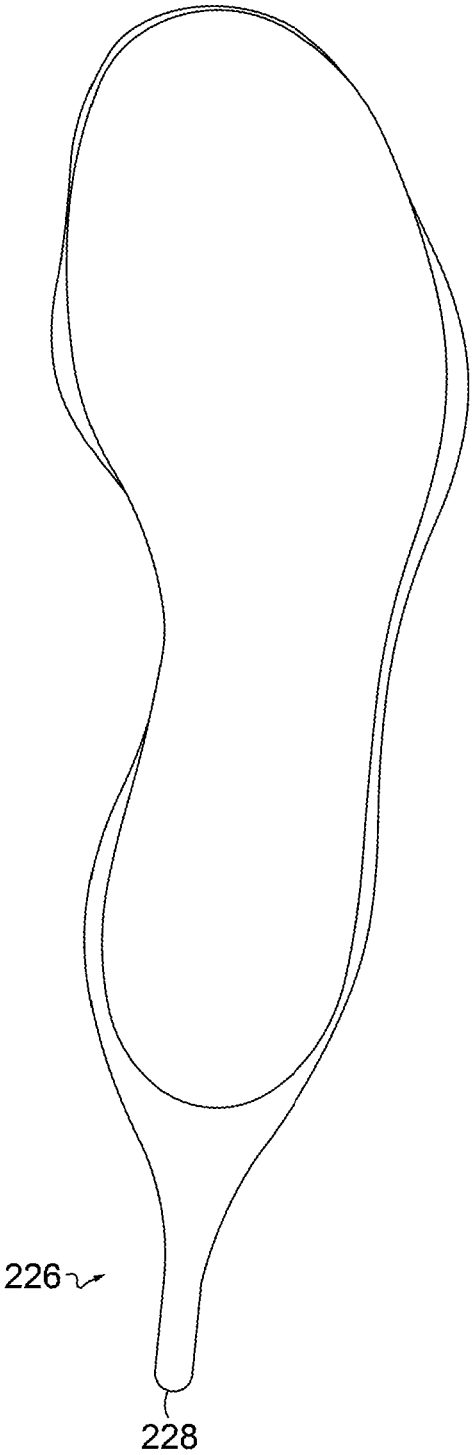

In other aspects of the disclosure, a different balance may be achieved between the drag reduction and other functionality of the footwear article by selecting heel extensions with other characteristics. For example, referring now to FIG. 7, another heel extension 126 is depicted. The heel extension 126 is similar to the heel extension 26, since the heel extension 126 includes a rearmost exterior point 128, however, the heel extension 126 of FIG. 7 is longer than the heel extension 26, and the medial and lateral sides taper at a smaller angle 150. In addition, the angle at which the top and bottom sides of the heel extension 126 taper may also be smaller than the heel extension 26. In another example depicted by FIG. 8, another heel extension 226 is depicted that also includes a rearmost exterior point 228. The heel extension 226 has been configured to include a fin-type structure that is narrower than the heel extension 26.

A heel extension may be integrated into a footwear article using various constructions. In one aspect, the transition between the heel extension and other portions of the footwear article, such as the outsole, midsole, and upper is made smooth and flush. Construction may include co-molding the heel extension together with one or more other portions of the midsole. For example, the surface of the heel extension 26 of FIGS. 1-3 smoothly transitions from the surfaces of the medial and lateral sides, and co-molding, casting, 3D printing, laser sintering (or other rapid manufacturing techniques), are some exemplary manufacturing techniques that may be used to construct the heel extension 26 integrally with the midsole.

Figure 9A:
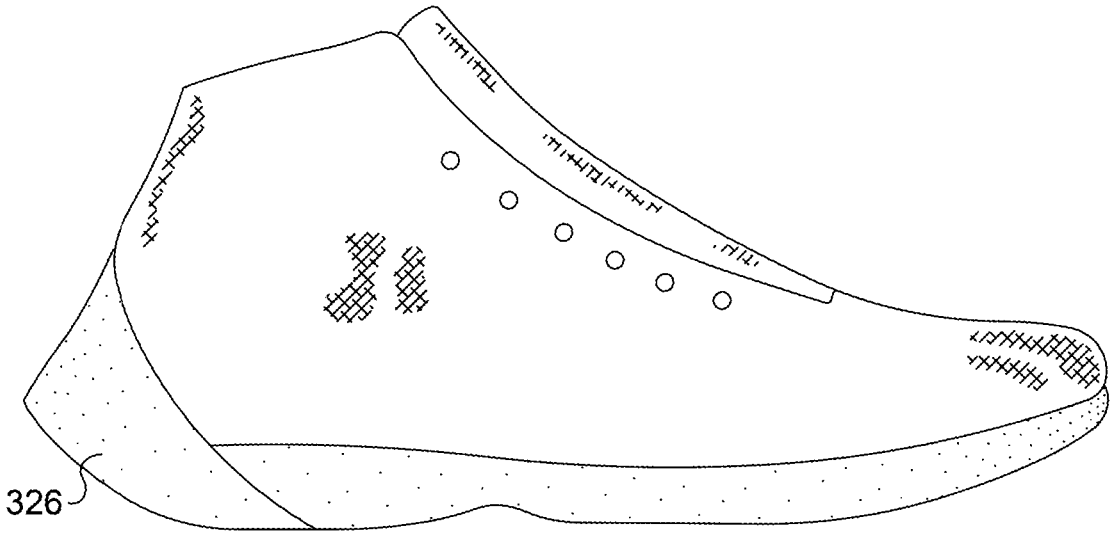
FIGS. 9A and 9B each depicts alternative footwear articles having alternative heel extensions in accordance with aspects hereof.

Referring to FIG. 9A, in other aspects a heel-extension member 326 may be a separate, discrete unit that is attachable to the heel region of a footwear article, such as by an adhesive, a mechanical fastener, or a wrap that is secured onto other portions of a shoe. As such, the discrete heel extension 326 may be affixed to a variety of different shoes, which may be retrofitted after an upper has already been attached to a sole. In one aspect, a releasable coupling mechanism may be used to attach a discrete heel-extension member 326 to a footwear article, and as used in this disclosure, a "releasable coupling mechanism" refers to a fastener that couples in a manner operational to repeatedly transition back and forth between a connected state and a disconnected state. For example, a releasable coupling may include a hook and loop fastener, a buckle fastener, a snap fastener, and the like. In yet another aspect, the discrete heel-extension member 326 may attach to a footwear article by way of a non-releasable coupling mechanism, and as used herein, a "non-releasable coupling mechanism" refers to a fastener that couples in a manner not operational to repeatedly transition back and forth between a connected state and a disconnected state. For example, a non-releasable coupling may include stitching, bonding, sonic welding, adhering, riveting, tacking, integrally knitting, integrally weaving, integrally braiding, melding, thermosetting, and the like.

Figure 9B:
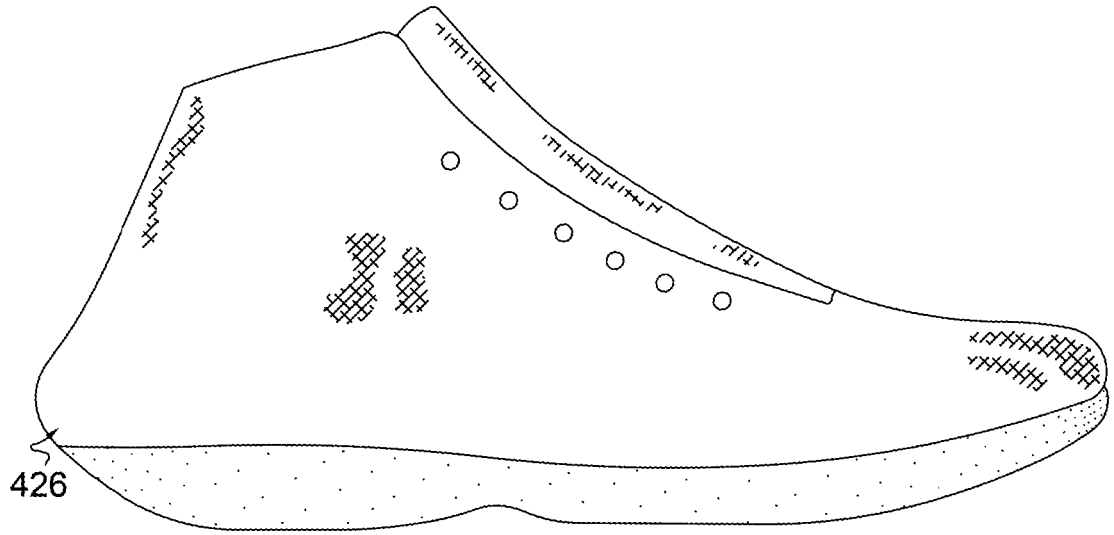

In other instances, as depicted by FIG. 9B, a heel extension 426 may be formed as a part of the upper, such as an elongated heel counter, or other heel-wrap-around structure. The heel-wrap-around structure may form the outermost layer of the upper, or may be formed as an intermediate layer secured between or beneath other upper material layers.

Figure 10A:
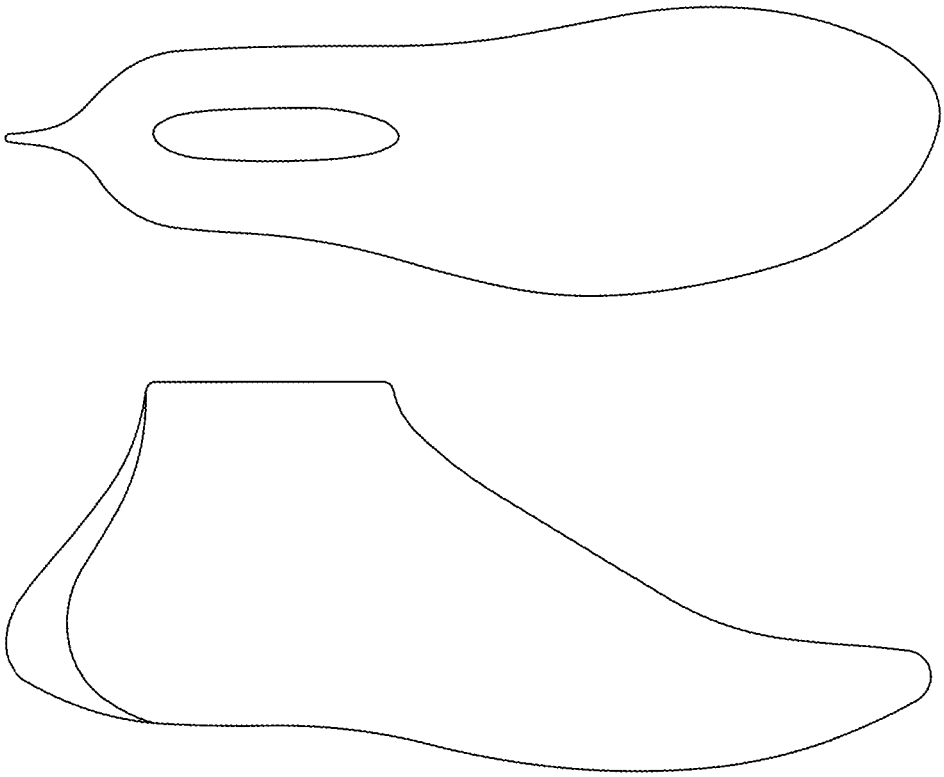
FIGS. 10A-10D each depicts general profiles of different footwear articles, each of which has a different heel extension in accordance with aspects hereof.
Figure 10B:
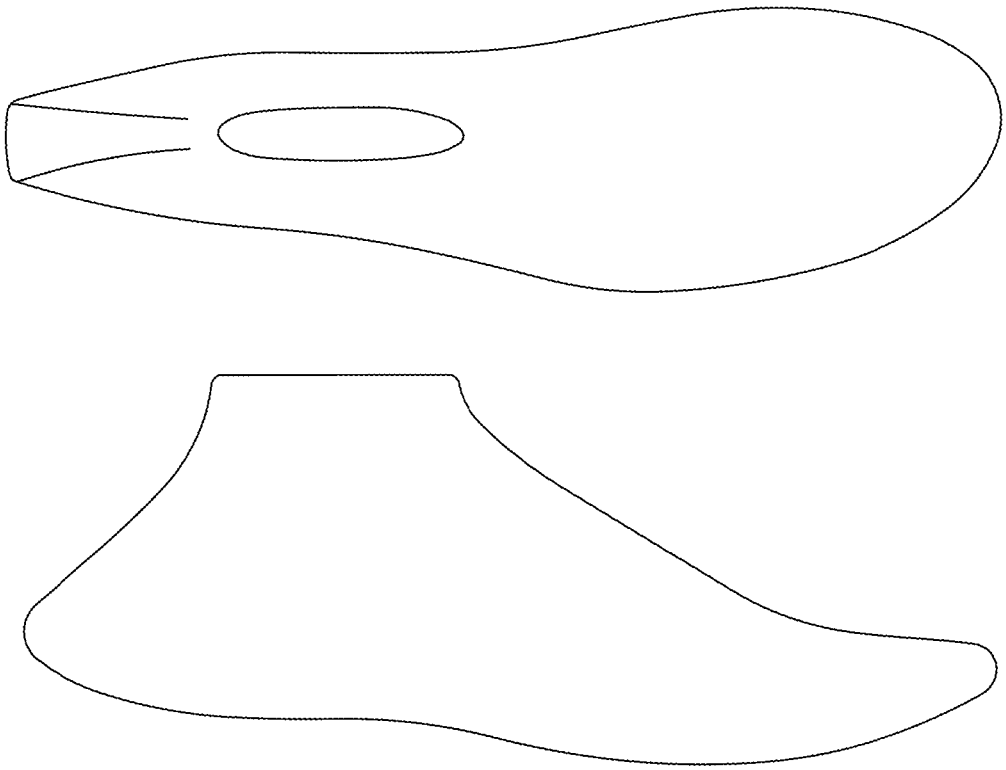
Figure 10C:
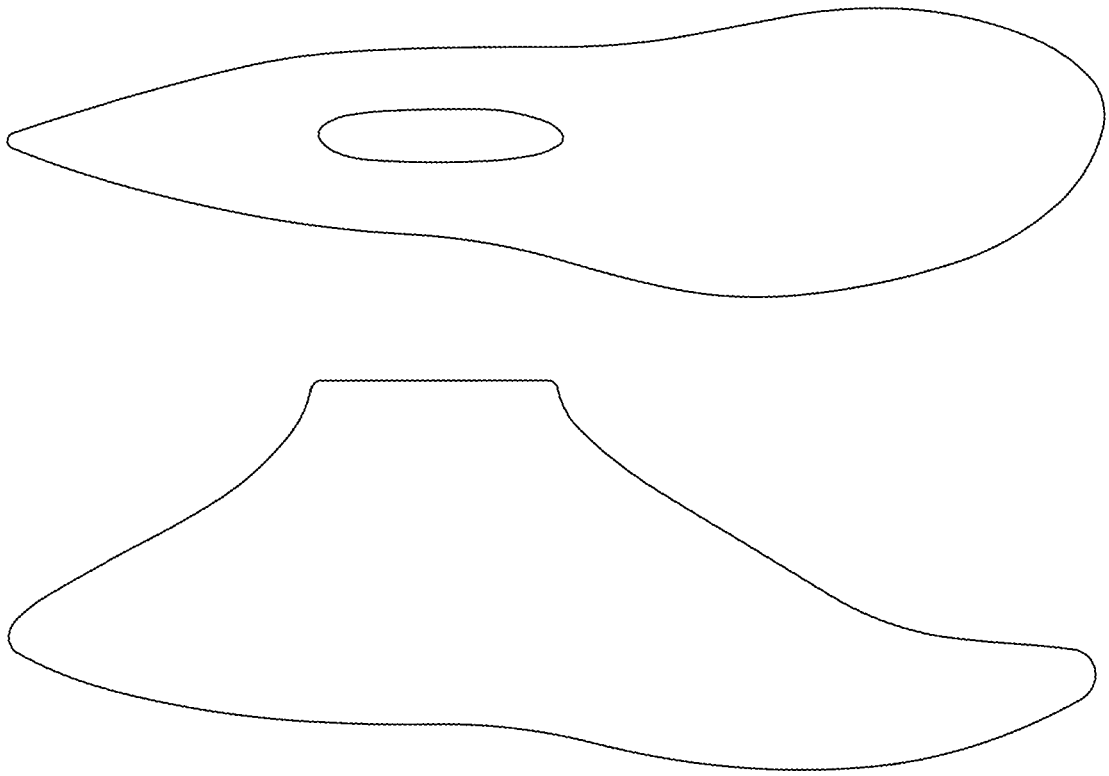
Figure 10D:
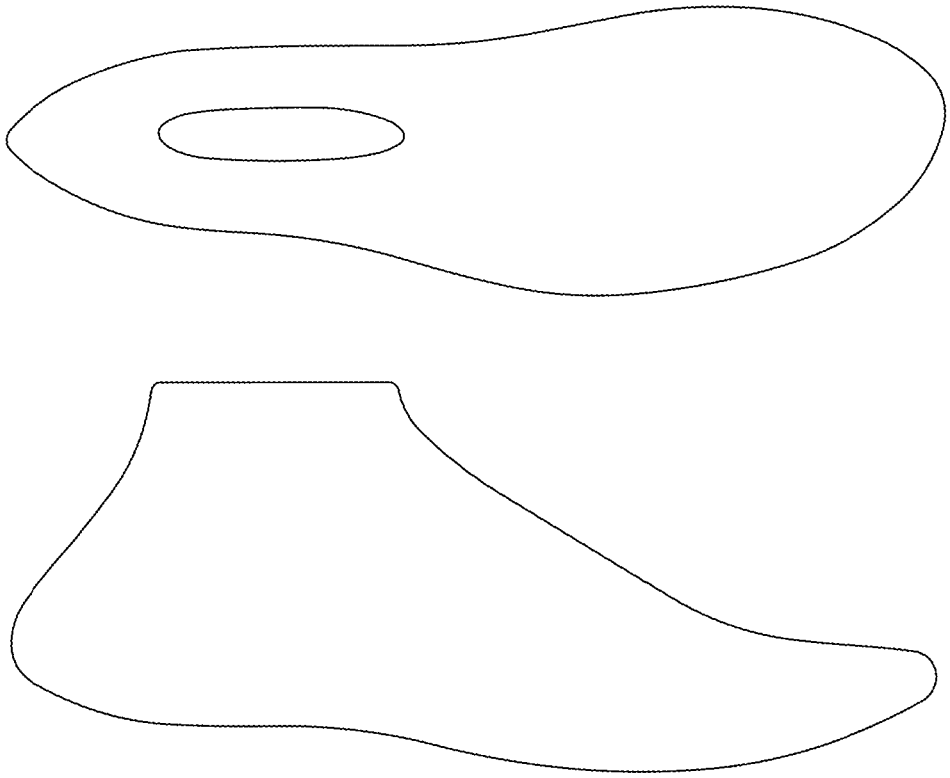

Referring to FIGS. 10A-10D, top and side profiles of various footwear articles with heel extensions are illustrated. For example, FIG. 10A illustrates a fin-style heel extension having a relatively uninterrupted extension of the side-view silhouette and a significant, more drastic narrowing through the length of the heel extension. In another aspect, FIG. 10B depicts a "kammback" structure that may also achieve an amount of drag reduction. The kammback structure includes a relatively smooth contour and transition from the medial and lateral sides into the heel extension, and as an alternative to the heel extensions 26, 126, and 226, the kammback structure is more abruptly cut off prior to reaching the rounded, terminal endpoint 28. FIGS. 10C and 10D illustratively depict respective heel extensions that are similar to the extensions 26 and 126 by showing examples of a longer cowling in FIG. 10C and a shorter cowling in FIG. 10D. That is, the silhouettes depicted in FIGS. 10C and 10D illustrate that the general shape of heel extensions may have some features in common and that the heel extensions can be modified by extending or reducing the length of the heel extension.

Figure 11:
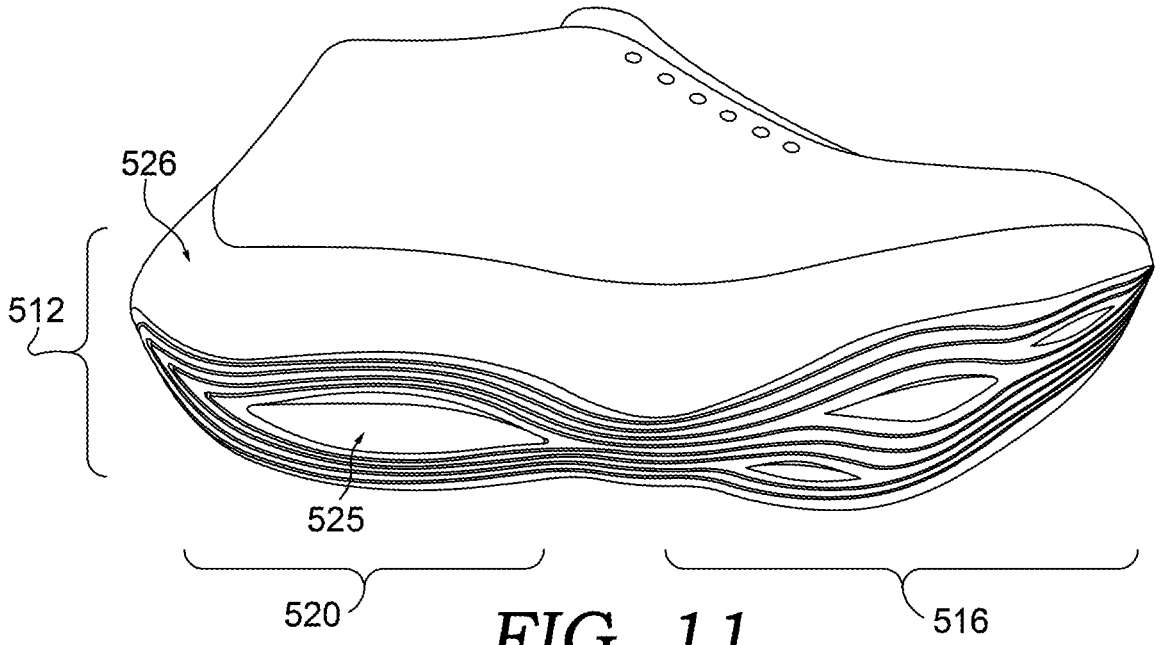
FIG. 11 depicts another alternative footwear article having a heel extension in accordance with an aspect of this disclosure.

In a further aspect, FIG. 11 depicts a sole 512 with a cowling-style heel structure 526, and the sole 512 has some alternative features. For example, the sole 512 includes a heel region 520 and a forefoot region 516, and as compared with the sole 12, the ratio of the size of the forefoot region 516 to the size of the heel region 520 is larger. This larger amount of tapering from the forefoot to the heel (as compared with the sole 12) may affect the aerodynamics of the sole 512 in a manner different than the sole 12. In addition, the sole 512 includes a recessed portion 525 that may also affect the aerodynamics. Again, one or more features of each of these types of heel extensions may be selected to achieve a balance with one or more other aspects of the footwear article, such as the overall weight, limited interference with gait or footstrike, and the like.

Figure 12:
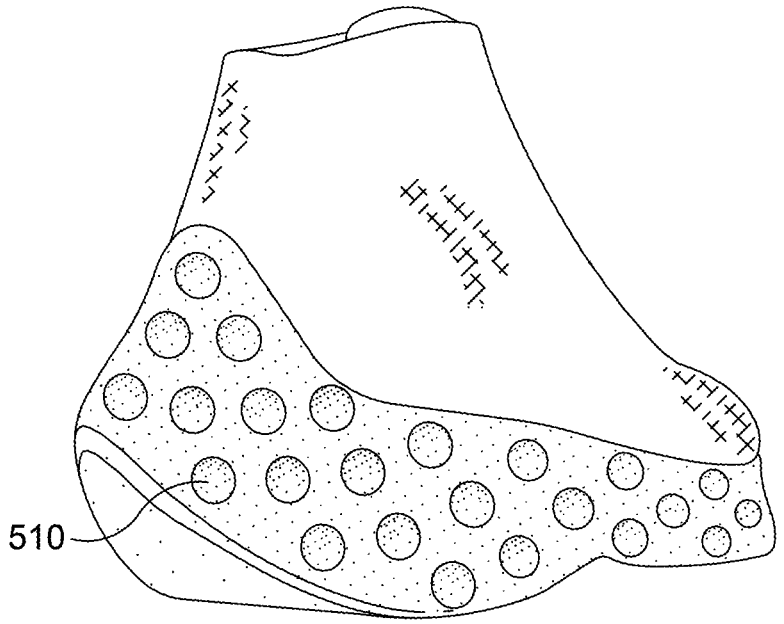
FIG. 12 depicts a rear perspective view of another alternative footwear article having a heel extension with a surface feature in accordance with an aspect of this disclosure.

In another embodiment, a surface of the heel extension may have one or more drag-reducing surfaces. For example, the heel-extension surface may be relatively smooth, as depicted in FIGS. 1-3. Or in other aspects, as depicted by FIG. 12, the heel-extension surface may include raised nodes, or dimples 510 in order to affect the drag properties of the footwear article. In addition, FIGS. 1-3 depict a relatively flat or planar face on the medial and lateral side. And in other aspects, the medial and/or lateral sides may include curves, ridges, and the like.

Having described various aspects illustrated in FIGS. 1-12, as well as alternative aspects, some additional aspects will now be described that may related to on one or more of the illustrated, or alternative aspects. For example, one aspect of the disclosure includes a sole for a footwear article, the sole including a forefoot region, a midfoot region, and a heel region aligned in a longitudinal orientation. In addition, the sole includes a midsole sidewall having an interior facing surface configured to attach to one or more portions of an upper. The interior facing surface includes a rearward-most, interior-facing surface in the heel region and a forward-most, interior facing surface in the forefoot region. The rearward-most, interior facing surface is spaced a first distance from the forward-most, interior facing surface. The sole also includes a heel extension protruding rearward from the heel region and in a direction generally aligned with the longitudinal orientation. The heel extension includes a rearmost exterior point of the footwear article, and the rearmost exterior point is spaced a second distance from the rearward-most, interior facing surface in the heel region. In one aspect, the second distance comprises a percentage of the first distance in a range of about eight percent to about twenty percent. Another aspect includes a footwear article that includes a sole having a heel extension with these described features.

Another aspect of the present disclosure is also related to a sole for a footwear article, the sole including a forefoot region, a midfoot region, and a heel region aligned in a longitudinal orientation. In addition, the sole includes a midsole sidewall having an interior facing surface configured to attach to one or more portions of an upper, and the interior facing surface includes a rearward-most, interior-facing surface in the heel region. The sole also includes a heel extension protruding rearward from the heel region and in a direction generally aligned with the longitudinal orientation, and the heel extension includes a rearmost exterior point of the footwear article. The heel extension also includes a top-side median ridge that slopes downward as the top-side median ridge extends away from the heel region and towards the rearmost exterior point. In addition, the heel extension includes a medial side and a lateral side that are separated from one another by the top-side median ridge and that converge towards the rearmost exterior point by tapering from a wider portion closer to the heel region to a narrower region closer to the rearmost exterior point. In one aspect of the disclosure, the medial side and the lateral side form an angle with one another as each side converges towards the rearmost exterior point, and the angle is in a range of about 55 degrees to about 65 degrees. Another aspect includes a footwear article that includes a sole having a heel extension with these described features.

A further aspect of the present disclosure includes a sole for a footwear article, the sole including a forefoot region, a midfoot region, and a heel region aligned in a longitudinal orientation. In addition, the sole includes a midsole sidewall having an interior facing surface configured to attach to one or more portions of an upper. The interior facing surface includes a rearward-most, interior-facing surface in the heel region and a forward-most, interior facing surface in the forefoot region. The rearward-most, interior facing surface is spaced a first distance from the forward-most, interior facing surface. The sole also includes a heel extension protruding rearward from the heel region and in a direction generally aligned with the longitudinal orientation. The heel extension includes a rearmost exterior point of the footwear article, and the rearmost exterior point is spaced a second distance from the rearward-most, interior facing surface in the heel region. In one aspect, the second distance comprises a percentage of the first distance in a range of about eight percent to about twenty percent. Furthermore, the heel extension may also include a top-side median ridge that slopes downward as the top-side median ridge extends away from the heel region and towards the rearmost exterior point. In addition, the heel extension includes a medial side and a lateral side that are separated from one another by the top-side median ridge and that converge towards the rearmost exterior point by tapering from a wider portion closer to the heel region to a narrower region closer to the rearmost exterior point. In one aspect of the disclosure, the medial side and the lateral side form an angle with one another as each side converges towards the rearmost exterior point, and the angle is in a range of about 55 degrees to about 65 degrees. Another aspect includes a footwear article that includes a sole having a heel extension with these described features.

From the foregoing, it will be seen that aspects described herein are well adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible aspects described herein may be made without departing from the scope thereof, it is to be understood that all matter herein set forth or shown in the accompanying drawings is to be interpreted as illustrative and not in a limiting sense.

The invention claimed is:

1. A footwear article comprising:

a sole structure having a forefoot region, a midfoot region, a heel region, and a heel extension aligned in a longitudinal orientation; wherein the heel extension protrudes rearward from the heel region and in a direction generally aligned with the longitudinal orientation;

the heel extension comprises a rearmost exterior point of the footwear article;

the heel extension includes a medial-side edge and a lateral-side edge that taper towards one another and converge at the rearmost exterior point and that are positioned at a transition from a midsole portion to an outsole portion of the sole structure; and the heel extension includes a top side and a bottom side, the bottom side comprising a concave surface generally arching in a medial-to-lateral orientation.

2. The footwear article of claim 1, wherein at least a portion of the bottom side comprises an outsole tread element, and wherein at least a portion of the concave surface includes an exposed midsole portion without the outsole tread element.

3. The footwear article of claim 1, wherein at least a first portion of the bottom side comprises an outsole tread element; and wherein at least a second portion of the bottom side includes an exposed midsole portion without the outsole tread element.

4. The footwear article of claim 1, wherein the heel extension comprises a top side, and wherein the top side and the bottom side taper from a wider portion closer to the heel region to a narrower portion closer to the rearmost exterior point.

5. The footwear article of claim 4, wherein top side comprises a top-side median ridge that slopes downward as the top-side median ridge extends away from the heel region and towards the rearmost exterior point.

6. The footwear article of claim 5, wherein:

the top-side median ridge has a first length extending between the heel region and the rearmost exterior point;

the top-side medial ridge includes a plurality of radii along the first length; and the plurality of radii gradually decrease in dimension from the heel region towards the rearmost exterior point.

7. The footwear article of claim 1, wherein the outsole portion is generally oriented in an outsole plane, wherein the medial-side edge and the lateral-side edge each extends from a first position closer the heel region to a second position closer to the rearmost exterior point; and wherein the first position is closer to the outsole plane than the second position.

8. The footwear article of claim 7, wherein the medial-side edge and the lateral-side edge converge toward an apex at the rearmost exterior portion as each extends from the first position, which is lower, to the second position, which is higher.

9. A footwear article comprising:

a sole having a forefoot region, a midfoot region, a heel region, and a heel extension aligned in a longitudinal orientation; wherein:

the heel extension protrudes rearward from the heel region and in a direction generally aligned with the longitudinal orientation;

the heel extension comprises a rearmost exterior point of the footwear article;

the heel extension comprises a medial-side edge and a lateral-side edge that taper towards one another, that converge at the rearmost exterior point, and that are positioned at a transition from a midsole portion to an outsole portion of the sole structure;

the heel extension comprises a top-side median ridge that slopes downward as the top-side median ridge extends away from the heel region and towards the rearmost exterior point;

the heel extension includes a bottom side;

at least a first portion of the bottom side comprises an outsole tread element comprising part of the outsole portion; and at least a second portion of the bottom side includes an exposed midsole portion that is without the outsole tread element and that comprises part of the midsole portion.

10. The footwear article of claim 9, wherein:

the top-side median ridge has a length extending between the heel region and the rearmost exterior point;

the top-side median ridge includes a plurality of radii along the length; and the plurality of radii gradually decrease in dimension from the heel region towards the rearmost exterior point.

11. The footwear article of claim 9, wherein the outsole portion is generally oriented in an outsole plane; wherein the medial-side edge and the lateral-side edge each extends from a first position closer the heel region to a second position closer to the rearmost exterior point; and wherein the first position is closer to the outsole plane than the second position.

12. The footwear article of claim 11, wherein the medial-side edge and the lateral-side edge converge toward an apex at the rearmost exterior portion as each extends from the first position, which is lower, to the second position, which is higher.

13. The footwear article of claim 9, wherein the heel extension includes a bottom side comprising a concave surface generally arching in a medial-to-lateral orientation.

14. The footwear article of claim 13, wherein at least a portion of the bottom side comprises an outsole tread element comprising part of the outsole portion, and wherein at least a portion of the concave surface includes an exposed midsole portion that is without the outsole tread element and that comprises part of the midsole portion.

15. The footwear article of claim 9, wherein the bottom side and the top-side median ridge taper towards the rearmost exterior point.

16. A footwear article comprising:

a sole having a forefoot region, a midfoot region, a heel region, and a heel extension aligned in a longitudinal orientation; wherein:

the heel extension protrudes rearward from the heel region and in a direction generally aligned with the longitudinal orientation;

the heel extension comprises a rearmost exterior point of the footwear article;

the heel extension comprises a top-side median ridge that slopes downward as the top-side median ridge extends away from the heel region and towards the rearmost exterior point and that includes decreasing radii as the top-side median ridge extends from the heel region toward the rearmost exterior point; and the heel extension includes a top side and a bottom side, the bottom side comprising a concave surface generally arching in a medial-to-lateral orientation.

* * * * *